US005251536A

United States Patent [19]

Engel

[11] Patent Number: 5,251,536

[45] Date of Patent: Oct. 12, 1993

[54] AXIAL PISTON PUMP WITH OFF-CENTER PIVOT

[75] Inventor: William K. Engel, Peoria, Ill.

[73] Assignee: Caterpillar Inc., Peoria, Ill.

[21] Appl. No.: 821,101

[22] Filed: Jan. 15, 1992

[51] Int. Cl.[5] ..... F04B 1/26

[52] U.S. Cl. ..... 91/506; 417/222.1

[58] Field of Search ..... 91/499, 504, 505, 506; 417/222 R

[56] References Cited

U.S. PATENT DOCUMENTS

| | | | |
|---|---|---|---|
| 2,114,076 | 4/1938 | Gölz | 91/506 |
| 2,502,546 | 4/1950 | Adams | 417/722 R |
| 3,130,593 | 4/1964 | Boulet | 91/506 |
| 3,139,006 | 6/1964 | Budzich | 91/506 |
| 3,161,023 | 12/1964 | Margolin | 91/505 |
| 3,230,893 | 1/1966 | Hann et al. | 103/162 |
| 3,324,797 | 6/1967 | Christenson | 91/506 |
| 3,667,867 | 6/1972 | Boydell | 91/506 |
| 4,168,632 | 9/1979 | Fokker | 91/505 |
| 4,433,596 | 2/1984 | Scalzo | 91/505 |
| 4,483,663 | 11/1984 | Myers | 417/222 R |
| 5,000,667 | 3/1991 | Taguchi et al. | 91/505 |
| 5,095,807 | 3/1992 | Wagenseil | 91/505 |

*Primary Examiner*—Richard A. Bertsch

*Assistant Examiner*—Peter Korytnyk

*Attorney, Agent, or Firm*—John W. Grant

[57] ABSTRACT

Variable displacement axial piston pumps are useful in outputting pressurized fluid to operate fluid actuators. The currently available center pivoted variable displacement axial piston pumps waste energy by compressing trapped volumes of oil during operation. The present variable displacement axial piston pump has first and second opposite sides of a swash plate pivotally connected to a pump housing by a pair of off-center pivots with the angle of the swash plate being controlled by first and second actuators connected to the opposite sides of the swash plate. Each of the off-center pivots includes a pair of pivot pins connected to the housing and releasably pivotally seated in a pair of semi-cylindrical pockets formed in the opposite sides of the swash plate. The first actuator at the first side of the swash plate holds the semi-cylindrical pocket seated against the pivot pin while the second actuator controls pivotal movement of the swash plate about the first off-center pivot. The off-center pivots are preferably located such that the trapped volume of oil is minimized and remains substantially constant between the minimum and maximum displacement settings of the swash plate.

9 Claims, 3 Drawing Sheets

AXIAL PISTON PUMP WITH OFF-CENTER PIVOT

TECHNICAL FIELD

This invention relates generally to axial piston pumps and more particularly to variable displacement axial piston pumps having a swash plate with an off-center pivot.

BACKGROUND ART

Variable displacement axial piston pumps typically have a center pivoted swash plate. Some such pumps use trunnion bearings while others use a half shell or cradle support having either sliding or roller bearings. Those pumps have the advantage of simplicity in construction and logic, but also have the disadvantage that as displacement is adjusted from maximum to zero the pistons settle in on their mid-stroke position. This results in the piston cylinders retaining a volume of "trapped" oil therein during operation with the trapped volume being dependent upon the displacement setting of the pump. The trapped volume varies from essentially zero at maximum displacement of the pump to about half the displacement volume of the pump at its zero displacement setting. Oil is slightly compressible under high pressure and a considerable amount of energy is required to compress the oil at high pressures normally achieved by axial piston pumps. The energy is recovered from the oil pumped from the pump, but much of the energy expended in compressing the volume of trapped oil is lost.

Thus, it is desirable to provide a variable displacement axial piston pump in which the trapped volume of oil is held to a minimum therein throughout the full range of the displacement settings of the pump.

The present invention is directed to overcoming one of more of the problems as set forth above.

DISCLOSURE OF THE INVENTION

In one aspect of the present invention, a variable displacement axial piston fluid translating device has a housing, a cylinder barrel rotatably mounted within the housing, a plurality of axially extending circumferentially spaced bores therein, a plurality of pistons reciprocal within the bores, and a swash plate operatively associated with the pistons and having first and second opposite sides. The fluid translating device comprises an off-center pivot means for pivotally connecting the first side of the swash plate to the housing. An actuator means is connected to the second side of the swash plate for controlling pivotal movement of the swash plate about the off-center pivot means between minimum and maximum displacement settings of the fluid translating device.

BEST MODE FOR CARRYING OUT THE INVENTION

Figure 1:
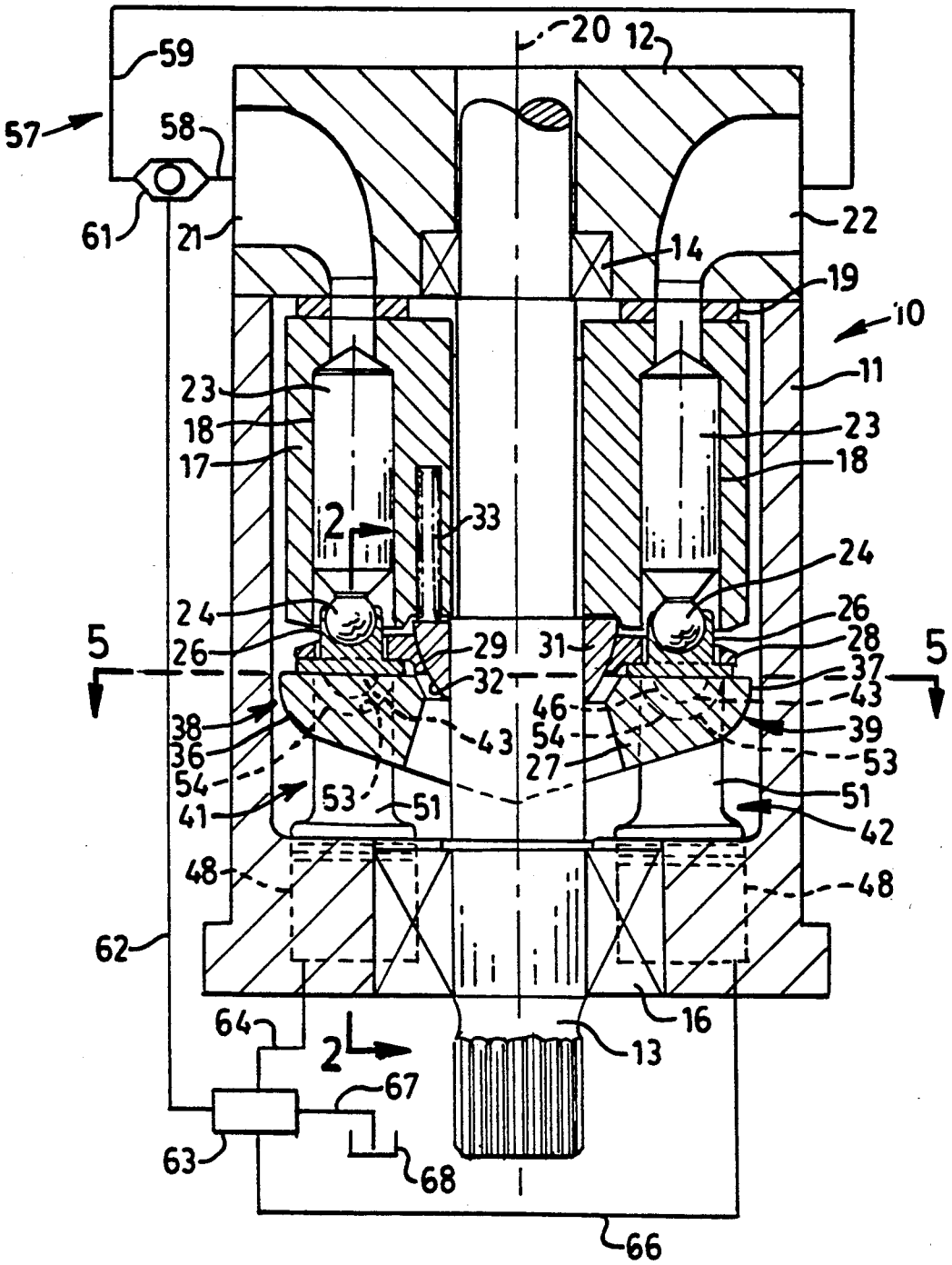
FIG. 1 is a cross-sectional view of an embodiment of the present invention.
Figure 2:
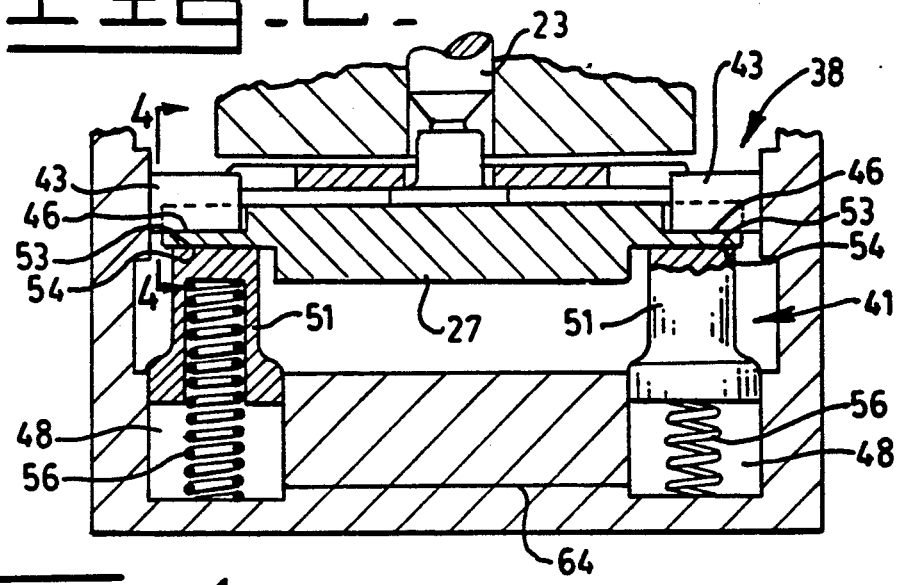
FIG. 2 is a sectional view taken along line 2—2 of FIG. 1.
Figure 4:
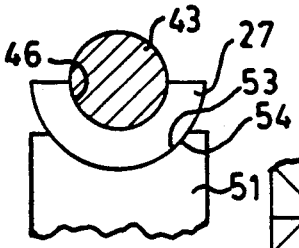
FIG. 4 is an enlarged sectional view taken along line 4—4 of FIG. 2.

A variable displacement reversible axial piston fluid translating device such as a pump 10 includes a housing 11 and a head 12 suitably secured to the housing. A shaft 13 extends through the housing and is rotatably mounted thereto via a pair of axially spaced bearings 14,16. A cylinder barrel 17 is suitably coupled to the shaft 13 for rotation therewith and has a plurality of axially extending circumferentially spaced bores 18. A timing port plate 19 is disposed between the cylinder barrel 17 and functions to selective communicate the bores 18 with a pair of inlet-outlet ports 21,22 in the usual manner upon rotation of the barrel 17 within the housing. The pump 10 has a longitudinal axis or center line 20.

A plurality of cylindrical pistons 23 are reciprocal within the bores 18. Each of the pistons 23 has a spherical end 24 seated within a piston shoe 26. The piston shoes are slidably supported on a swash plate 27 and are held in contact therewith by an annular shoe plate 28 having a spherical shaped central bore 29 extending therethrough, a ring 31 slidably disposed on the shaft 13 and having a spherical shaped outer surface 32 seated in the spherical shaped bore 29, and a plurality of springs, one shown at 33 resiliently urging the ring 31 toward the swash plate 27. The swash plate 27 has first and second opposite sides 36,37.

A pair of off-center pivot means 38,39 are provided for releasably pivotally connecting the first and second sides 36,37 respectively of the swash plate 27 to the housing 11. Each of the pivot means 38,39 has an axis 40 offset from the longitudinal center line 20 of the pump 10. A pair of actuator means 41,42 are connected to the first and second sides 36,37 respectively of the swash plate for controlling pivotal movement of the swash plate about the off-center pivot means between minimum and maximum displacement settings of the pump to establish first and second directions of operation of the pump.

Each of the off-center pivot means includes a pair of axially aligned pivot pins 43 connected to the housing and extending therefrom toward each other. A pair of semi-cylindrical pockets 46 are formed in the swash plate and opening generally toward the cylinder barrel 17.

Each of the actuator means 41,42 includes a pair of laterally spaced parallel bores 48 formed in the housing 11 and opening toward the swash plate 27. A pair of pistons 51 are slidably disposed in the bores 48 with each piston having a semi-cylindrical pocket 53 seated on a matching semi-cylindrical surface 54 formed on the swash plate. The surfaces 54 are concentric with the respective cylindrical pocket 53. Each of the bores 48 contains a spring 56 to resiliently urge the pistons 51 outwardly of the bores so that the pockets 53 remain seated against the cylindrical surface 54.

A valve means 57 is provided for controlling fluid flow into and out of the bores 48 in the housing 11. The valve means 57 includes a pair of conduits 58,59 connected to the ports 21,22 respectively, a shuttle valve 61 connected to the conduits 58,59, another conduit 62 connected to the shuttle valve, a selector valve 63 connected to the conduit 62, a pair of actuator conduits 64,66 connected to the selector valve 63 and to the bores 48 of the actuator means 41,42 respectively, and a drain conduit 67 connecting the selector valve 63 to a reservoir 68.

While the invention has been described as a pump, it is readily recognized that the same principle can be applied to a variable displacement axial piston motor.

Industrial Applicability

Reversible variable displacement pumps such as the pump 10 described above are typically used in systems having a charge pump, not shown, communicating with the inlet-outlet ports 21,22 through appropriate valving to maintain a minimum pressure level in the port having the lowest pressure therein. When the swash plate 27 is in the zero displacement setting as shown in FIG. 1, that charge pressure is communicated through one of the conduits 58 or 59, the shuttle valve 61 and the conduit 62 to the valve 63. At the neutral position of the valve 63, the pressurized fluid in the line 62 is directed to all of the bores 48 where it cooperates with the springs 56 to hold the pistons 51 and thus the swash plate 27 and the associated components in the position shown in FIG. 1.

Figure 3:
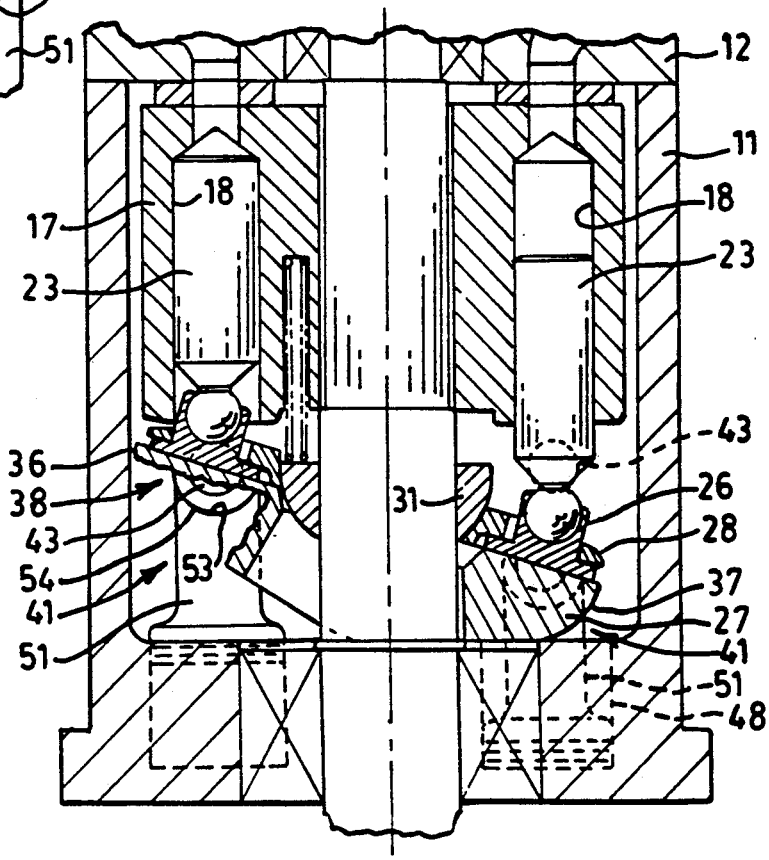
FIG. 3 is a partial sectional view similar to FIG. 1 with elements in an actuated position.
Figure 5:
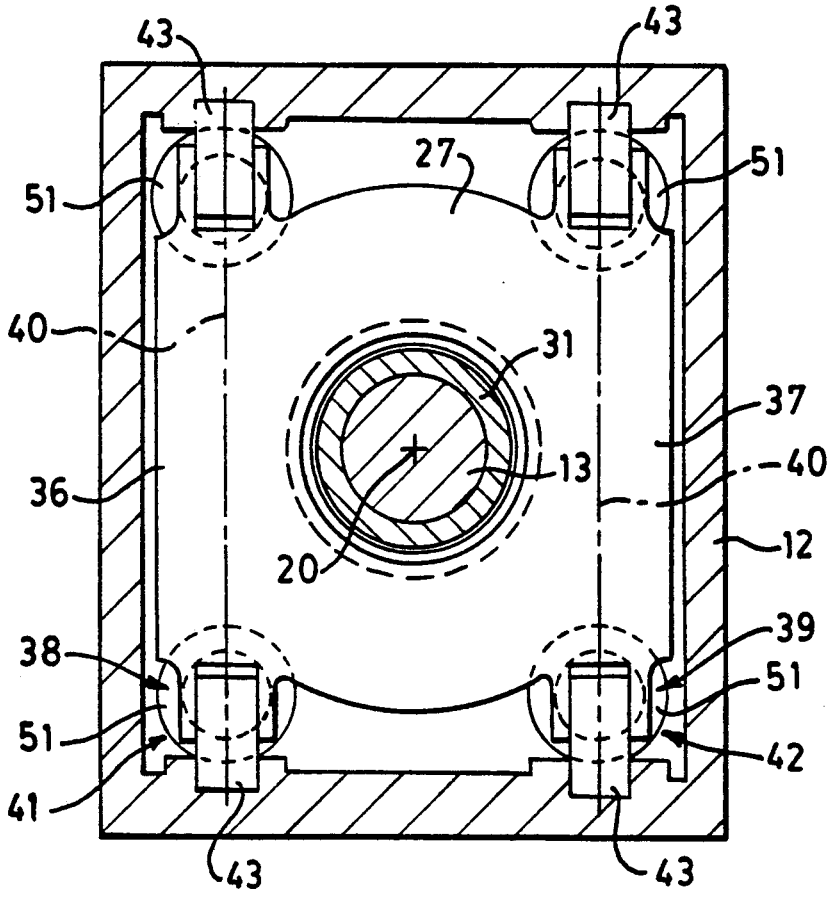
FIG. 5 is a sectional view taken along line 5—5 of FIG. 1.

To pump fluid from the port 22, the swash plate 27 is pivoted about the pivot pins 43 of the pivot means 38 as at the side 36 of the swash plate with the semi-cylindrical pockets 46 at the side 37 of the swash plate physically separating from the pivot pins 43 of the pivot means 39 shown in FIG. 3 to establish one direction of operation of the pump. This is accomplished by moving the valve 63 to block fluid flow from the conduit 62 to the bores 48 of the actuator means 42 and subsequently controllably venting these bores to the tank 68. Initially, the charge pressure in the piston bores 18 acting on the pistons 23 forces the side 37 downwardly toward the position shown in FIG. 3. Thereafter the fluid pressure thus generated in the piston bores 18 continues the downward movement of the side 37 of the swash plate. Also once the pump 10 starts to output fluid through the port 22, the port 22 becomes the high pressure port and the port 21 becomes the low pressure port. The higher fluid pressure in the port 22 is thus transmitted through the shuttle valve 61 and the valve 63 to the bores 48 of the actuator means 41. This insures that the pistons 51 of the actuator means 41 forceably maintains pivotably seating engagement between the pivot pins 43 and the semi-cylindrical pockets 46 of the pivot means 38 as the swash plate pivots about the pivot means 38. When the swash plate reaches the desired displacement position the valve 63 is moved to a position blocking communication between the actuator conduit 66 and the reservoir 68 to thereby hydraulically lock the pistons 51 of the actuator means 42 at the desired location. In the meantime, the valve 63 continues to communicate the conduit 62 with the conduit 64 and thus the bores 48 of the actuator means 41 to hold the semi-cylindrical pockets 46 in contact with the pivot pins 43 of the pivot means 38. This insures that the pistons 51 of the actuator means 41 forcibly maintains rotational seating engagement between the pivot pins 43 and the semi-cylindrical pockets 46 of the pivot means 38 when the swash plate is pivoted about the pivot means 38.

To return the swash plate 27 to the zero displacement position, the valve 63 is manipulated to again direct pressurized fluid from the conduit 62 to the bores 48 of the actuator means 42 to hydraulically move the pistons 51 thereof upwardly to seat the pockets 46 against the pivot pins 43 of the pivot means 39.

Similarly fluid can be pumped from the port 21 by pivoting the swash plate 27 about the pivot means 39 similarly to that described above In view of the above, it is readily apparent that the structure of the present invention provides an improved pump in which the trapped volume remains substantially constant throughout the total displacement range of the pump with such trapped volume being greatly minimized. By minimizing the trapped volume of fluid, the pump is more efficient since lesser amounts of energy is used to compress the trapped volume of fluid.

Other aspects, objects and advantages of this invention can be obtained from a study of the drawings, disclosure, and the appended claims.

I claim:

1. A variable displacement axial piston fluid translating device having a housing, a cylinder barrel rotatably mounted within the housing and having a plurality of axially extending circumferentially spaced piston bores therein, a plurality of pistons reciprocal in the piston bores, and a swash plate associated with the pistons and having first and second opposite sides comprising:

off-center pivot means for pivotally connecting the first side of the swash plate to the housing, including a pair of axially aligned pivot pins connected to the housing and a semi-cylindrical pocket formed in the first side of the swash plate, the pivot pins being rotatably seated in the semi-cylindrical pockets; and actuator means connected to the second side of the swash plate for controlling pivotal movement of the swash plate about the off-center pivot means between minimum and maximum displacement settings of the fluid translating device.

2. The fluid translating device of claim 1 wherein the actuator means includes a bore in the housing, a piston slidably disposed in the bore and engaging the second side of the swash plate, and valve means for controlling fluid flow into and out of the bore in the housing.

3. The fluid translating device of claim 2 wherein the fluid translating device has a pair of ports with one of the ports being a high pressure port and the other of the ports being a low pressure port, and including means for directing fluid from the high pressure port to the valve means.

4. The fluid translating device of claim 3 wherein in the pivot pins extend toward each other and the semi-cylindrical pockets open toward the cylinder barrel.

5. A variable displacement reversible axial piston fluid translating device having a housing, a cylinder barrel rotatably mounted within the housing and having a plurality of axially extending circumferentially spaced piston bores therein, a plurality of pistons reciprocal in the bores, and a swash plate operatively associated with the pistons and having first and second opposite sides comprising:

first off-center pivot means for releasably pivotally connecting the first side of the swash plate to the housing;

second off-center pivot means for releasably pivotally connecting the second side of the swash plate to the housing;

first actuator means connected to the first side of the swash plate for controlling pivotal movement of the swash plate about the second off-center pivot means to establish a first direction of operation of the fluid translating device; and second actuator means connected to the second side of swash plate for controlling pivotal movement of the swash plate about the first off-center pivot means to establish a second direction of operation of the fluid translating device.

6. The fluid translating device of claim 5 wherein the first pivot means includes a pair of axially aligned pivot pins connected to one of the housing and the first side of the swash plate and a pair of semi-cylindrical pockets formed in the other of the housing and the first of the swash plate, the first actuator means forcibly maintaining rotational seating engagement between the pivot pins and the semi-cylindrical pockets when the swash plate is being pivoted about the first pivot means.

7. The fluid translating device of claim 6 wherein the first actuator means includes a bore in the housing, a piston slidably disposed in the bore in the housing and engaging the first side of the swash plate, and valve means for controlling fluid flow into and out of the bore in the housing.

8. The fluid translating device of claim 7 wherein the pivot pins are connected to the housing and extend toward each other and the semi-cylindrical pockets are formed in the swash plate and open toward the cylinder barrel.

9. The fluid translating device of claim 8 including a pair of inlet-outlet ports, the valve means being connected to the inlet-outlet ports.

* * * * *